US005205194A

United States Patent [19]

Rodey

[11] Patent Number: 5,205,194

[45] Date of Patent: Apr. 27, 1993

[54] CAN OPENER APPARATUS

[76] Inventor: Fred W. Rodey, 237 Babcock Dr., Palatine, Ill. 60067

[21] Appl. No.: 924,758

[22] Filed: Aug. 4, 1992

[51] Int. Cl.[5] ..... B67B 7/44

[52] U.S. Cl. ..... 81/3.09; 81/3.4; 81/3.55; D8/40

[58] Field of Search ..... 81/3.07, 3.09, 3.4, 81/3.55, 3.57; 7/151; D8/33, 34, 40

[56] References Cited

U.S. PATENT DOCUMENTS 2,656,065 10/1953 Breeze ..... D8/40
3,845,675 11/1974 Cook ..... 81/3.27
4,949,600 8/1990 Tricinella ..... 81/3.09

FOREIGN PATENT DOCUMENTS 0813653 9/1951 Fed. Rep. of Germany ..... 81/3.07

*Primary Examiner*—Roscoe V. Parker
*Attorney, Agent, or Firm*—Leon Gilden

[57] ABSTRACT

An elongate shaft includes a top wall and bottom wall having a hook at the top wall, with a handle mounted diametrically through the shaft adjacent the bottom wall. A latch including a side wall rod having a head spaced from a side wall is arranged for receiving a looped can opening member to effect a rolling of the pop top to permit its spacing from an opening in a conventional pop top type container.

2 Claims, 3 Drawing Sheets

CAN OPENER APPARATUS

BACKGROUND OF THE INVENTION

1. Field of the Invention

The field of invention relates to can opening apparatus, and more particularly pertains to a new and improved can opener apparatus wherein the same is arranged for the ease of manipulation and separation of a can top lid relative to a container.

2. Description of the Prior Art

The lifting and separating of a can top relative to a container is frequently a difficult and arduous task, wherein individuals of limited physical capacity have at times difficulty in effecting this opening. Prior art to assist in such opening has been presented in U.S. Pat. No. 4,949,600 to Tricinella permitting the leveraged opening and lifting of a pop top relative to a pop top container. The instant invention, however, is directed to the manipulation of a can top to initially effect tensioning of the top and its subsequent folling relative to a container to permit ease of removal of a container lid relative to such a container and as such, it may be appreciated that there continues to be a need for a new and improved can opening apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of pop top opener structure now present in the prior art, the present invention provides a pop top can opener apparatus wherein the same is arranged for the lifting and separating of a can top relative to a container. As such, the general purpose of the present invention, which will be described subsequently in greater detail, is to provide a new and improved pop top can opener apparatus which has all the advantages of the prior art pop top opening apparatus and none of the disadvantages.

To attain this, the present invention provides an elongate shaft including a top wall and bottom wall having a hook at the top wall, with a handle mounted diametrically through the shaft adjacent the bottom wall. A latch including a side wall rod having a head spaced from a side wall is arranged for receiving a looped can opening member to effect a rolling of the pop top to permit its spacing from an opening in a conventional pop top type container.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved can opener apparatus which has all the advantages of the prior art can opener apparatus and none of the disadvantages.

It is another object of the present invention to provided a new and improved can opener apparatus which may be easily and efficiently manufactured and marketed.

It is a further object of the present invention to provide a new and improved can opener apparatus which is of a durable and reliable construction.

An even further object of the present invention is to provide a new and improved can opener apparatus which is susceptible of a low cost of manufacture with regard to both materials and labor, and which accordingly is then susceptible of low prices of sale to the consuming public, thereby making such can opener apparatus economically available to the buying public.

Still yet another object of the present invention is to provided a new and improved can opener apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
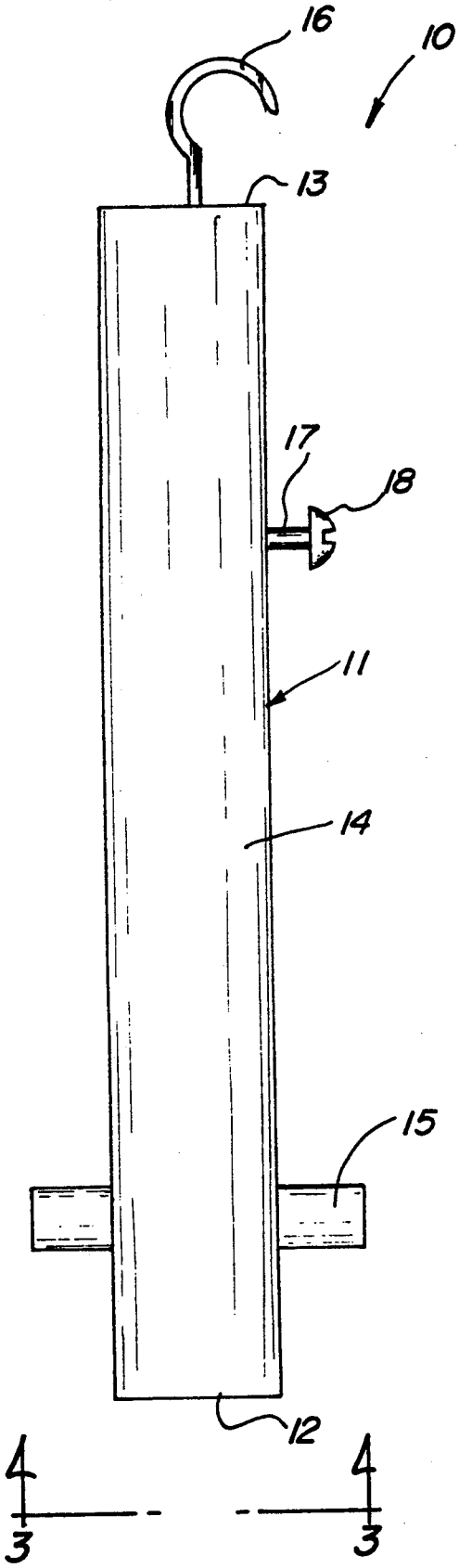
FIG. 1 is an orthographic view of the instant invention.
Figure 2:
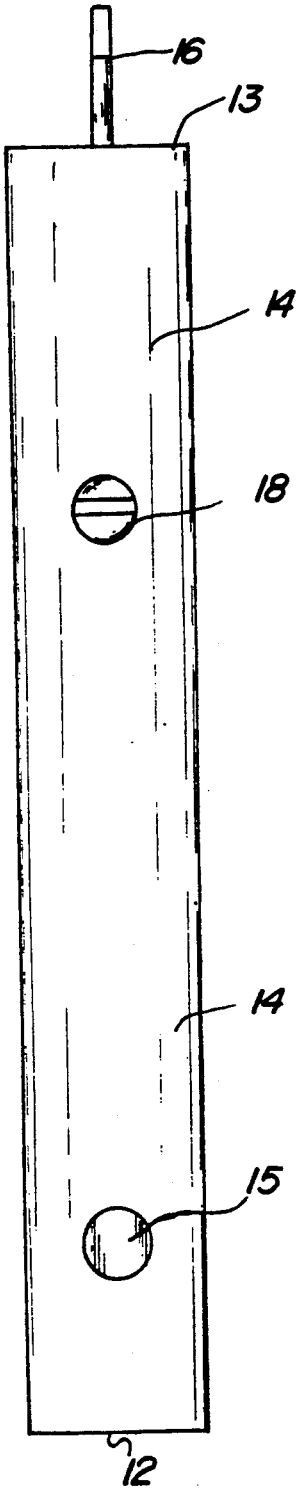
FIG. 2 is an orthographic view of the invention rotated ninety degrees relative to FIG. 1.
Figure 3:
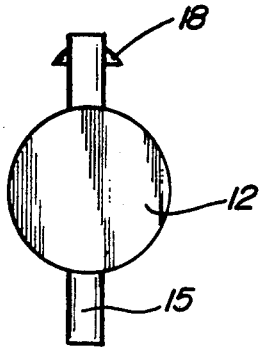
FIG. 3 is an orthographic view, taken along the lines 3—3 of FIG. 2 in the direction indicated by the arrows.
Figure 4:
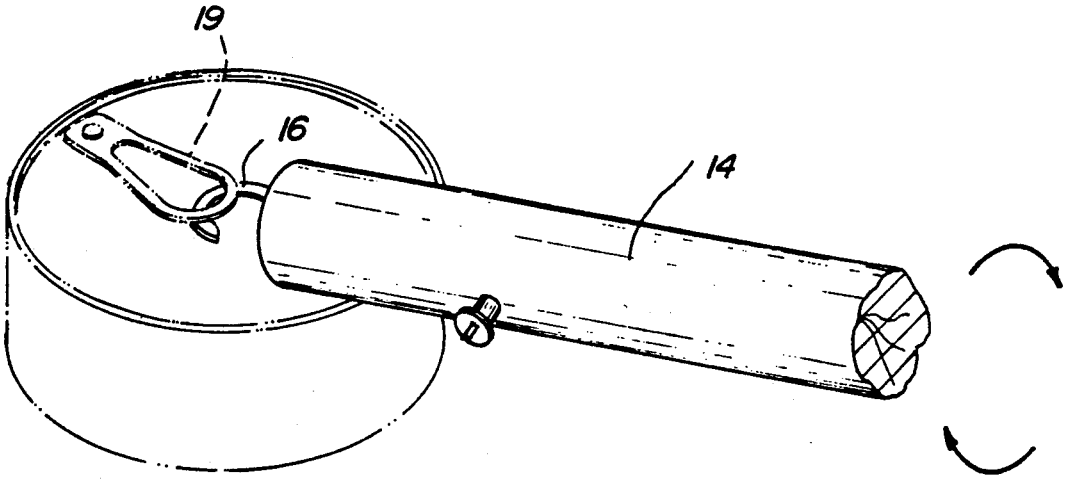
FIG. 4 is an isometric illustration of the invention in use in a first orientation relative to a container.
Figure 5:
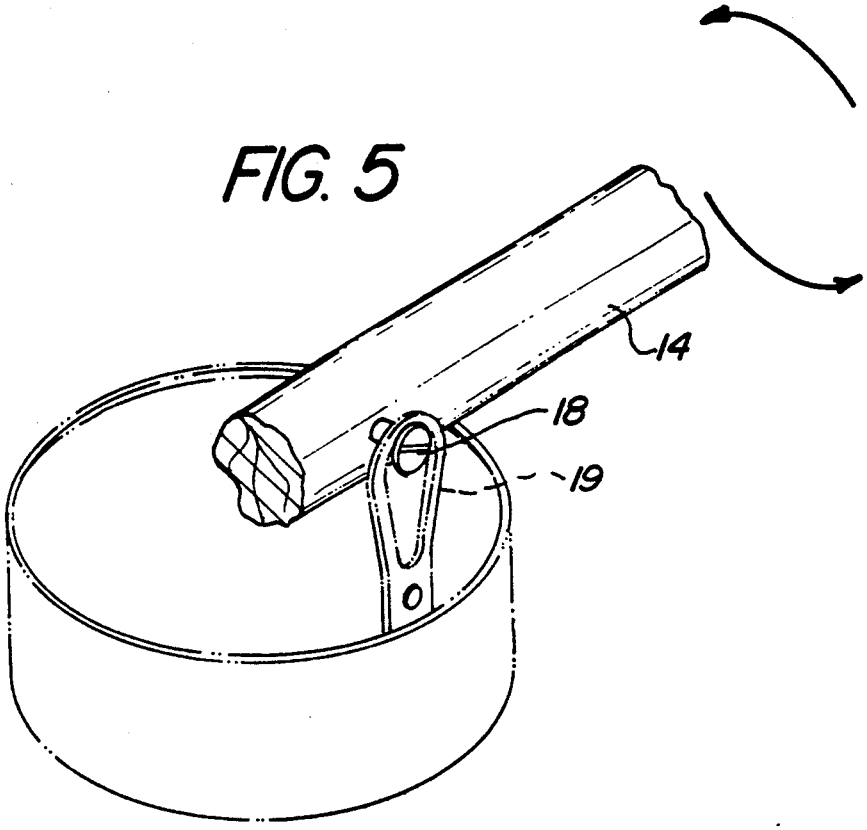
FIG. 5 is an isometric illustration of the invention utilized in a second orientation relative to container.

With reference now to the drawings, and in particular to FIGS. 1 to 5 thereof, a new and improved pop top opener apparatus embodying the principles and concepts of the present invention and generally designated by the reference numeral 10 will be described.

More specifically, the can opener apparatus 10 of the instant invention essentially comprises an elongate shaft 11 having a shaft bottom wall 12 spaced from and parallel a shaft top wall 13, wherein the bottom top walls are orthogonally oriented relative to an axis of the shaft 11. A cylindrical side wall 14 extends coextensively between the bottom and top walls as illustrated. A handle rod 15 is diametrically directed through the elongate shaft 11 adjacent the bottom wall orthogonally oriented relative to the shaft axis, with a hook member 16 fixedly mounted medially of the shaft top wall 13. A latch member is directed into the cylindrical side wall 14 having a side wall rod 17 orthogonally oriented relative to the latch axis oriented between the handle rod 15 and the top wall. The side wall rod 17 has a side wall rod head 18 extending laterally beyond the side wall rod fixedly mounted at an outer distal end of the side wall rod spaced from the cylindrical side wall 14.

In use, the hook member 16 is directed through a can lid loop 19, whereupon pulling of the handle rod effects a lifting and separation of the lid loop and lid relative to the container. Subsequently, the latch member is directed into the loop to effect a rolling of the lid loop relative to the container to effect continued and greater separation of the pop top relative to the container to effect an opening thereof.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A can opener apparatus, comprising, an elongate shaft, the elongate shaft having a bottom wall spaced from and parallel a top wall, with a cylindrical side wall extending coextensively between the bottom wall and top wall, with the cylindrical side wall defined by an elongate shaft axis, with the bottom wall and top wall orthogonally oriented relative to the shaft axis, and a hook member mounted to the top wall projecting exteriorly thereof, and a latch member mounted to the side wall projecting from the side wall and spaced adjacent the top wall, and a handle rod is diametrically directed through the elongate shaft adjacent the bottom wall between the latch member and the bottom wall.

2. An apparatus as set forth in claim 1 wherein the latch member includes a side wall rod orthogonally oriented relative to the shaft axis projecting exteriorly of the side wall, and the side wall rod having an enlarged head mounted to an outer distal end of the side wall rod spaced from the cylindrical side wall, with the side wall rod head extending laterally beyond the side wall rod for engagement of a pop top by the side wall rod head on the side wall rod.

* * * * *